US005146236A

United States Patent [19]

Hirata et al.

[11] Patent Number: 5,146,236

[45] Date of Patent: Sep. 8, 1992

[54] INK JET RECORD APPARATUS

[75] Inventors: Tositaka Hirata, Tokyo; Minoru Ameyama, Yokohama; Hiromichi Komai, Yokohama; Osamu Naruse, Yokohama; Syuzo Matsumoto, Yokohama; Tomoaki Nakano, Yokohama, all of Japan

[73] Assignee: Ricoh Company, Ltd., Tokyo, Japan

[21] Appl. No.: 624,619

[22] Filed: Dec. 10, 1990

[30] Foreign Application Priority Data

Dec. 14, 1989 [JP] Japan ..... 1-324772

[51] Int. Cl.[5] ..... B41J 2/07; B41J 2/045

[52] U.S. Cl. ..... 346/1.1; 346/140 R

[58] Field of Search ..... 346/140 R, 1.1, 75; 400/126; 358/298

[56] References Cited

U.S. PATENT DOCUMENTS 4,499,479 2/1985 Chee-Shuen Lee et al. ... 346/140 R
4,513,299 4/1985 Lee et al. ..... 346/140 R
4,866,462 9/1989 Watanabe ..... 346/140 R

FOREIGN PATENT DOCUMENTS 0123034 9/1979 Japan ..... 346/140 R
0144358 7/1986 Japan ..... 346/140 R

*Primary Examiner*—Benjamin R. Fuller
*Assistant Examiner*—Alrick Bobb
*Attorney, Agent, or Firm*—Cooper & Dunham

[57] ABSTRACT

An ink jet record apparatus for driving a drop-on-demand ink jet head with a piezoelectric element in a printing apparatus. The ink jet record apparatus includes a first drive part for driving and operating the ink jet head in a first operation mode, a second drive part for driving and operating the ink jet head in a second operation mode, a selection part for changing an operation of the ink jet head from the first operation mode to the second operation mode or vice versa, and a control part for supplying a drive signal to the selection part in accordance with input image information, thus allowing a size of ink dots on paper to be adjusted through selection of either the first operation mode or the second operation mode.

11 Claims, 6 Drawing Sheets

1ST OPERATION MODE

2ND OPERATION MODE

INK JET RECORD APPARATUS

BACKGROUND OF THE INVENTION

The present invention generally relates to an ink jet record apparatus, and more particularly to an ink jet record apparatus for driving and operating a drop-on-demand type ink jet head using a piezoelectric element, which may be applied to an ink jet printer and the like.

Conventionally, there are several non-impact type printers, especially an ink jet printer using a ink jet head with a piezoelectric element, or a bubble jet printer using a heating element. Recently, there has been a demand in the field for such conventional recording apparatus having a high-quality half tone recording capability. To achieve a desired half tone recording by means of the conventional recording apparatus, there are two methods that have been used primarily by the conventional recording apparatus. One method is to vary a pulse width of a drive signal to be applied to a ink jet head of the recording apparatus for controlling the size of ink dots on paper, and the other is to vary a voltage of a drive signal applied to the ink jet head. The ink jet printer usually employs either of the two methods described above. However, in the case where the former method is used, the pulse width can be varied through a digital signal processing, but it is difficult to change significantly the diameter of an ink drop come out from a nozzle of the ink jet head. Also, in the case where the latter method is used, it is necessary to use an analog signal processing to vary a drive voltage applied to the ink jet head, which requires a complicated drive circuit in the recording apparatus, causing the manufacturing cost to be high.

In addition, there is another method that has been used by the conventional recording apparatus. In this method, the weight of an ink droplet come out from the nozzle of the ink jet head is varied to control the size of the ink dots on the paper. To change the weight of the ink droplet, it is necessary to adjust a drive voltage applied to the ink jet head. It is known that the ink drop weight is varied in proportion to a change in the drive voltage applied to the ink jet head, and that the ink jet speed is also changed in proportion to a change in the drive voltage applied to the ink jet head. If the ink droplet weight is changed to be smaller than the current ink droplet weight, the drive voltage must be varied in accordance with the change in the ink droplet weight, and thereby the ink jet speed becomes smaller. For instance, in a serial scan type ink jet recording apparatus, the ink jet head is moved in a main scan direction while ink comes out from the nozzle of the ink jet head, and therefore variations of the ink jet speed may influence significantly the accuracy with which ink dots are positioned on paper. When the speed of movement of the ink jet head in the main scan direction is assumed to be constant, it is desired that the ink jet speed be set to a relatively large value more accurate position ink dots on paper, because the ink jet speed set to a relatively large value can be adjusted within a wide range of allowable variations. However, in a case where the above conventional method is applicable for practical use, there is a problem in that the range of allowable variations in ink jet speed is limited. Also, determining an appropriate ink jet speed for the ink jet head is quite difficult when the ink droplet weight is made very small, as the ink jet speed is determined based on a change in the ink droplet weight, and when the ink droplet weight is small, the ink jet speed lies in a narrow range of allowable variations.

SUMMARY OF THE INVENTION

Accordingly, it is a general object of the present invention to provide an improved ink jet record apparatus in which the above described problems are eliminated.

Another and more specific object of the present invention is to provide an ink jet record apparatus for driving a drop-on-demand ink jet head which has a piezoelectric element, which apparatus comprises a first drive part for driving and operating the ink jet head in a first operation mode, a second drive part for driving and operating the ink jet head in a second operation mode, a selection part for changing an operation mode of the ink jet head from the first operation mode t the second operation mode or vice versa, and a control part for supplying a drive signal to the selection part in accordance with input image information, thus allowing a size of ink dots on a record paper to be adjusted through selection of either the first operation mode or the second operation mode. According to the present invention, it is possible for the same ink jet head to carry out both the first operation mode and the second operation with different diameters of ink dots through selection of the driving parts by the control part, thus allowing various levels of half tone printing. This ink jet record apparatus when used in conjunction with the conventional technique will enable a range of half tone printing levels wider than that in the conventional apparatus to be achieved.

Still another object of the present invention is to provide an ink jet record apparatus which comprises a first drive, part for driving and operating the ink jet multiple-nozzle head in the first operation mode in which an ink drop comes out from the nozzle when the piezoelectric element is stressed and then the pressure chamber is refilled with ink when the piezoelectric element returns back to a non-stressed condition, a second drive part for driving and operating the ink jet multiple-nozzle head in the second operation mode in which ink is refilled in the pressure chamber when the piezoelectric element returns from a stressed condition back to a non-stressed condition, and an ink drop comes out from the nozzle when the piezoelectric element is stressed again, a selection part for changing an operation of each of the ink jet multiple-nozzle head from the first operation mode to the second operation mode or vice versa when a signal is supplied in accordance with image information, the first operation mode defining a first dot density of ink jet printing and the second operation mode defining a second dot density of ink jet printing, the first dot density being smaller than the second dot density, the selection part allowing a size of ink dots on paper to be adjusted through selection of either the first dot density or the second dot density, and a signal control part for supplying the signal to the selection part in accordance with input image information for changing the operation of the ink jet multiple-nozzle head from the first operation mode to the second operation mode or vice versa. According to the present invention., it is possible to provide an improved ink jet record apparatus having a simple construction, which can select either the first operation mode or the second operation mode to vary the size of ink dots, thus allowing the same ink jet head to carry out printing at two different dot densities. And, it is possible to carry out fully several levels of half tone printing through a digital signal processing with the ink jet record apparatus according to the present invention.

Other objects and further features of the present invention will become apparent from the following detailed description when read in conjunction with the accompanying drawings.

DESCRIPTION OF THE PREFERRED EMBODIMENTS

Figure 1A:
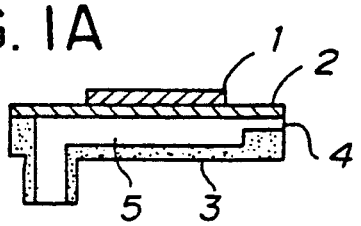
FIGS. 1A through 1C are sectional views of an ink jet head for explaining a first operation mode thereof by the ink jet record apparatus according to the present invention.
Figure 1B:
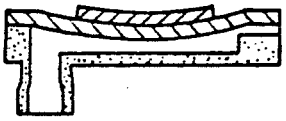
Figure 1C:
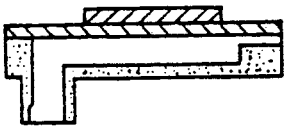
Figure 3A:
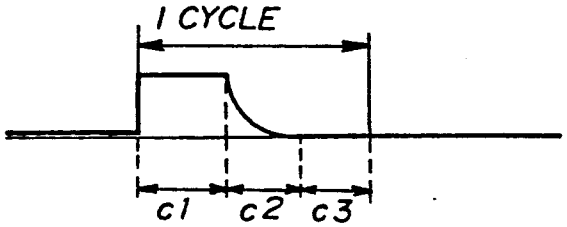
FIGS. 3A and 3B are diagrams showing a waveform of a drive signal both in the first operation mode and in the second operation mode.

First, a description will be given of a first operation mode of an ink jet head by the ink jet record apparatus according to the present invention, with reference to FIGS.1A through 1C and FIG.3A. FIGS.1A through 1C show a first operation mode of the ink jet head when a drive signal as indicated in FIG.3A is applied to the ink jet head. The first operation mode is hereinafter also referred to as a push-drive mode. In FIGS.1A through 1C, an ink jet head is provided which generally has a piezoelectric element 1, an oscillation plate 2, a head base 3, a nozzle 4 and an ink chamber 5. In the first operation mode of this ink jet head, when the drive signal is not yet applied to the ink jet head, the ink chamber 5 is placed in a non-stressed straight condition as shown in FIG.1A. In this condition of the ink jet head, when a part "cl" of the drive signal, as indicated in FIG.3A, is applied to the ink jet head, the piezoelectric element 1 is stressed and the oscillation plate 2 is bent inward to reduce the capacity of the ink chamber 5, as shown in FIG.1B. Ink within the ink chamber 5 is pressurized and an ink drop comes out from the nozzle 4 at this time. Then, since a voltage of the drive signal gradually falls to zero volt as indicated by "c2" in FIG.3A, the piezoelectric element 1 slowly returns back to the initial non-stressed condition as shown in FIG.1C. When the piezoelectric element 1 is changed from the condition shown in FIG.1B to the condition shown in FIG.1C, new ink is supplied from an ink storage part (not shown) and the ink chamber 5 is refilled with the same, the ink jet head being placed in a ready state for the next coming out of ink.

Figure 2A:
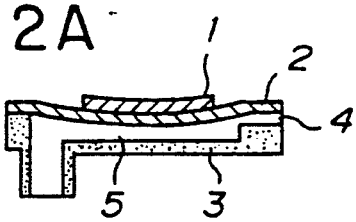
FIGS.2A through 2C are sectional views of the ink jet head for explaining a second operation mode thereof by the ink jet record apparatus.
Figure 2B:
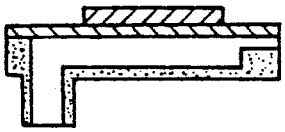
Figure 2C:
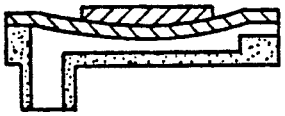
Figure 3B:
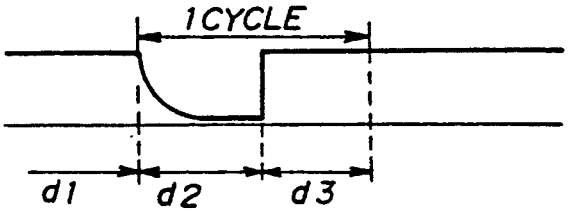

Referring next to FIGS.2A through 2C and FIG.3B, a description will be given of a second operation mode of the ink jet head by the ink jet record apparatus according to the present invention. In FIGS.2A through 2C, those parts which are the same as those corresponding parts of the apparatus shown in FIGS.1A through 1C are designated by the same reference numerals. The second operation mode is hereinafter also referred to as a pull-drive mode. As shown in FIG.2A, when a part of a drive signal as indicated by "dl" in FIG.3B is applied to the ink jet head, no printing is carried out but a prescribed voltage indicated by "dl" in FIG.3B is already applied to the piezoelectric element 1 of this ink jet head and the oscillation plate 2 is bent inward to the ink chamber 5 in a stressed or contracted condition as shown in FIG.2A. When the drive signal gradually falls to zero volt, as indicated by "d2" in FIG.3B, the oscillation plate 2 returns back to a non-stressed condition to expand the capacity of the ink chamber 5 as shown in FIG.2B so that new ink is supplied to the ink chamber 5 from the ink storage part (not shown) and the ink chamber 5 is refilled with the same, when the drive signal rises from zero volt to the voltage as indicated by "d3" in FIG.3B, the oscillation plate 2 is again bent inward to reduce the capacity of the ink chamber 5, as shown in FIG.2C, so that an ink drop comes out from the nozzle 4 of the ink jet head. According to the present invention, either the push-drive ink jet printing process or the pull-drive ink jet printing process is selected by the ink jet record apparatus by the control of the drive signal applied from an external signal source to the ink jet head, so that the diameter of ink dots on paper is suitably varied to achieve several levels of half tone printing by means of a plurality of ink jet heads in an ink jet printer.

Figure 4:
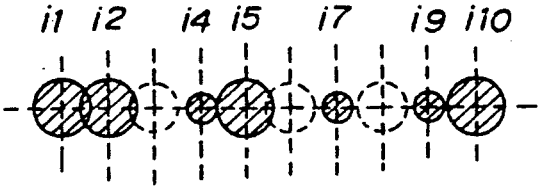
FIG.4 is a view showing an example of a line of ink dots printed by ink jet multiple-nozzle head provided in an ink jet printer in accordance with the principle of the present invention.
Figure 5:
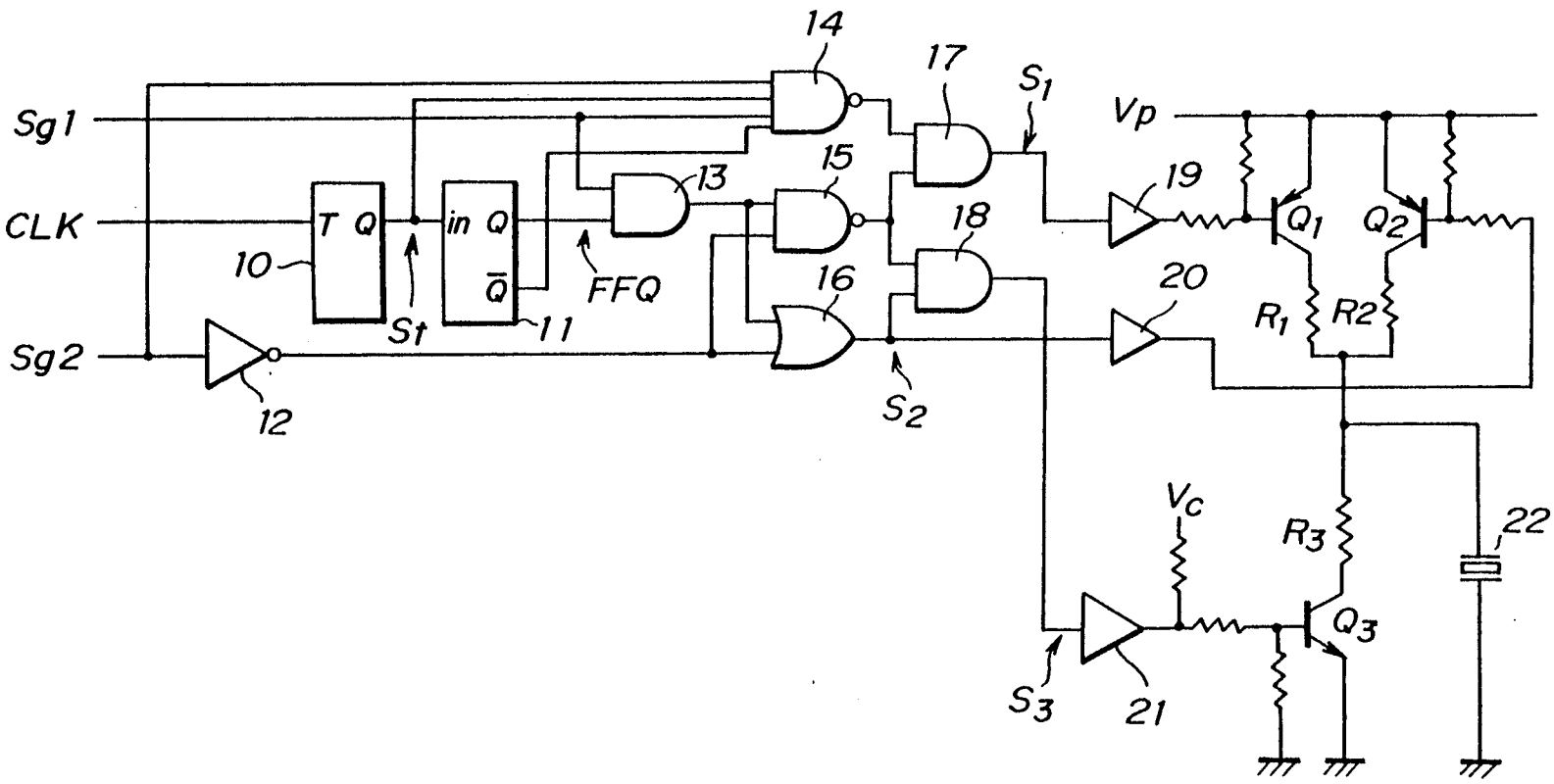
FIG.5 is a block diagram showing an embodiment of a driving circuit for driving and operating the ink jet head in accordance with the principle of the present invention.
Figure 6:
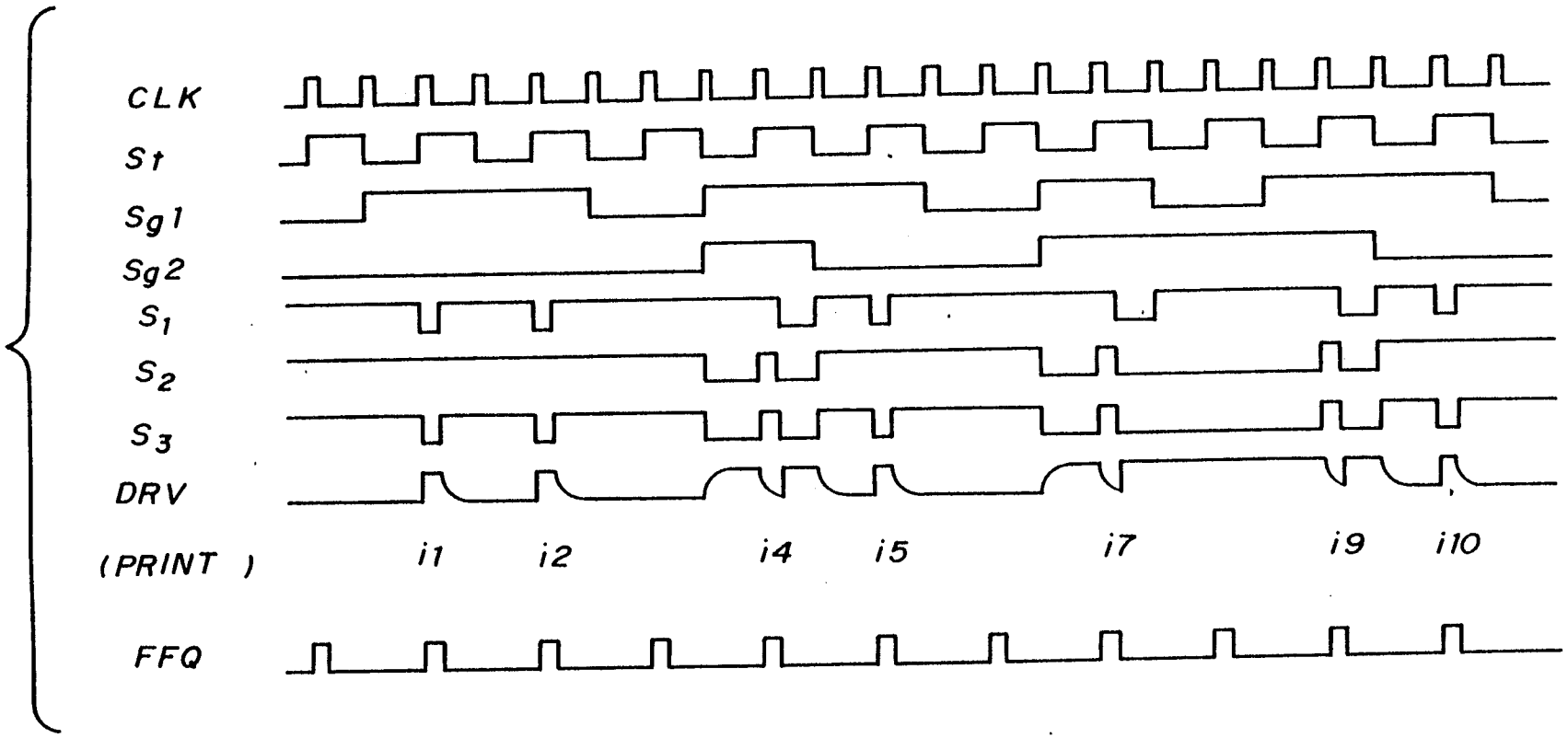
FIG.6 is a timing chart for explaining the operation of the driving circuit shown in FIG.5.

FIG.5 shows an example of a driving circuit which is a major part of the ink jet record apparatus, the driving circuit supplying a drive signal to the ink jet head in accordance with input image information to carry out half tone printing. FIG.6 is a timing chart for explaining the operation of the driving circuit shown in FIG.5. FIG.4 shows an example of a row of in dots printed by the ink jet multiple-nozzle head of an et printer in accordance with the timing chart shown in FIG.5. In the driving circuit shown in FIG.5, a print data signal (indicated by "Sgl" in FIG.6) carrying input image information is supplied to a terminal Sgl shown in FIG.5, and a selection signal (indicated by "Sg2" in FIG.6) for selecting either the first operation mode (push-drive mode) or the second operation mode (pull-drive mode) is supplied to a terminal Sg2 shown in FIG.5. These signals "Sgl" and "Sg2" are generated by and supplied from suitable signal sources (not shown), respectively. A basic clock timing signal (indicated by "CLK" in FIG.6) is supplied to a terminal CLK shown in FIG.5. A drive signal DRV applied to each ink jet head and intermediate signals S1, S2 and S3 are developed by this driving circuit shown in FIG.5 from the three input signals Sgl, Sg2 and CLK (or St). The driving circuit shown in FIG.5 generally has a bistable flip-flop circuit 10 a monostable flip-flop circuit 11, three AND gates 13, 17, 18, two NAND gates 14, 15, an OR gate 16, three buffer circuits 19, 20, 21, and a piezoelectric element 22. The bistable flip-flop circuit 10 and the monostable flip-flop circuit 11 are provided in the driving circuit to adjust the pulse width of the drive signal DRV which is applied to the piezoelectric element 22. The driving circuit further comprises two "p-n-p" transistors Q1, Q2 and a "n-p-n" transistor Q3, these transistors Q1 to Q3 being provided to output the drive signal DRV to the piezoelectric element 22 to control the coming out of ink drops from the nozzle of each ink jet head of an ink jet printer. The driving circuit further comprises a resistor R1 for protection of the transistor Q3, a resistor R2 for adjustment of a rising time of the drive signal DRV applied to the piezoelectric element 22, and a resistor R3 for adjustment of a falling time of the drive signal DRV applied to the piezoelectric element 22. The resistor R1 has a resistance lower than that of the resistors R2 and R3, and the respective resistances of the resistors R2 and R3 are predetermined depending on the electrostatic capacity of the piezoelectric element 22, and on the rising time and falling time of the drive signal DRV applied to the ink jet head.

Next, a description will be given of the operation of the driving circuit shown in FIG.5 When first ink dots il and i2 along a main scan line, as shown in FIG.4, are printed on paper by an operation of the ink jet head in the first operation mode, the transistor Q1 is turned ON and the transistor Q3 is turned OFF. Electric current flows across the transistor Q1 and the resistor R1 to the piezoelectric element 22 so that the oscillation plate 2 is bent inward to reduce the capacity of the ink chamber 5 so that an ink drop comes out from the nozzle of the ink jet head. Then, the transistor Q1 is switched OFF and the transistor Q3 is switched ON so that charge carriers in the piezoelectric element 22 are discharged to the resistor R3 and the transistor Q3. In this case, if the resistor R3 has a relatively great resistance, it is possible to slow discharging of the charge carriers from the piezoelectric element 22. This helps prevent external air from entering the ink chamber 4 through the nozzle 4. Next, when an ink dot i4 shown in FIG.4 is printed on paper by an operation of the ink jet head in the second operation mode (pull-drive mode), the oscillation plate 2 must be first placed in a stressed condition, as shown in FIG.2A. After a selection signal Sg2 is applied to change the operation mode of the ink jet head from the first operation mode to the second operation mode, the ink jet head is operated in the second operation mode. The transistor Q2 is turned ON to apply a voltage to the piezoelectric element 22 through the resistor R2. If this resistor R2 has a relatively great resistance, it is possible to slow the movement of the piezoelectric element 22. In actual use, the transistor Q2 is first turned OFF and the transistor Q1 is turned ON to slowly discharge charge carriers from the piezoelectric element 22. After the ink chamber 5 returns back to a condition shown in FIG.2B, the transistor Q1 is turned ON so that the ink chamber 5 is contracted so that ink comes out from the nozzle 4.

Changing the operation of the ink jet head from the second operation mode (pull-drive mode) to the first operation mode (push-drive mode) is carried out by the ink jet record apparatus as follows. Switching the transistor Q3 ON when the transistors Q1 and Q2 are turned OFF allows the charge carriers to be slowly discharged from the piezoelectric element 22 via the resistor R3 and the transistor Q3. And, the ink chamber 5 returns back to a non-stressed condition shown in FIG.1A which is a ready state of the ink jet head for re-starting the first operation mode of the ink jet head.

As described in the foregoing, a row of ink dots with two different sizes as shown in FIG.4 can be printed on paper by developing and supplying the drive signal DRV and the intermediate signals Sl, S2, S3 from the input signals Sgl, Sg2, CLK and by suitably switching the transistors Q1, Q2 and Q3 on and off.

Next, a description will be given of a concrete example of an ink jet head to which the present invention may be applied, with reference to FIG.7. This example of the ink jet head is a piezoelectric type drop-on-demand ink jet head which can perform selectively either a 300 dpi recording or a 600 dpi recording. In the ink jet head shown in FIG.7, there are provided a nozzle 31, a passage plate 32, a pressure chamber 33, a fluid resistance 34, a common chamber 35, an electrode 36, a PCB 37, a piezoelectric element 38 joined onto substrate 39 and a protective plate 40. In a first operation mode (push-drive mode) of this ink jet head, this piezoelectric element 38 is stressed when a high level drive signal DRV shown in FIG.6 (corresponding to a part "cl" of the pulse shown in FIG.3A) is applied to the ink jet head. When this piezoelectric element 38 is bent inward to reduce the capacity of the pressure chamber 33, an ink drop comes out from the nozzle 31. And, when a part "c2" of the pulse shown in FIG.3A is applied to the ink jet head, the piezoelectric element 38 is gradually moved outward to enlarge the capacity of the pressure chamber 33 and returned back to a non-stressed condition, and the pressure chamber 33 is refilled with ink from the common chamber 35. And, when a part "c3" of the pulse (zero volt) shown in FIG.3A is applied to the ink jet head, the piezoelectric element 38 is placed in the initial non-stressed condition. Therefore, in the first operation mode, first an ink drop comes out from the nozzle of the ink jet head and next the pressure chamber is refilled with ink from the common chamber. In practical applications, a response of the ink fluid is slightly delayed in comparison with a response of an electric signal when applied to the ink jet head.

In a second operation mode (pull-drive mode) of the above ink jet head, when a prescribed voltage (corresponding to a part "dl" of the pulse of FIG.3B) is already applied to the ink jet head, the piezoelectric element 38 is in a stressed condition, which is already bent inward to the pressure chamber 33. When the print data signal Sgl is changed from a low level to a high level, the drive signal DRV is changed, synchronous to the change of the print data signal Sgl, from the prescribed voltage gradually to zero volt (corresponding to a part "d2" of the pulse shown in FIG.3B). At this time, the piezoelectric element 38 is gradually moved outward to expand the capacity of the pressure chamber 33 and the pressure chamber 33 is refilled with ink from the common chamber 35. And, when the drive signal DRV is changed from zero volt to the prescribed voltage (corresponding to a part "d3" of the pulse shown in FIG.3B), the piezoelectric element 38 is stressed and again bent inward to reduce the capacity of the pressure chamber 33, and the ink within the pressure chamber 33 is pressurized so that an ink drop comes out from the nozzle 31 of the ink jet head. Therefore, in the second operation mode, first the pressure chamber is refilled with ink from the common chamber and next an ink drop comes out from the nozzle of the ink jet head.

Figure 8A:
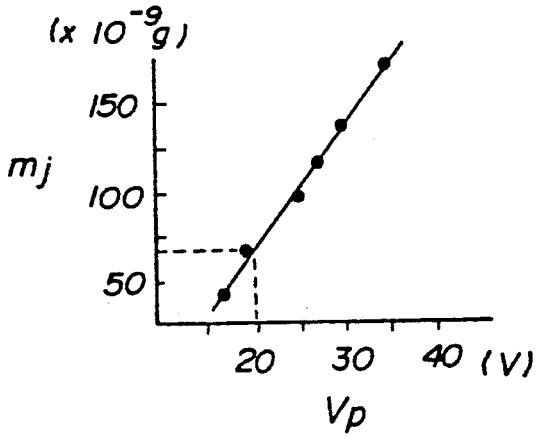
FIGS.8A and 8B show characteristic charts of the ink jet head of FIG.7 in the first operation mode when a drive voltage applied thereto is varied.
Figure 8B:
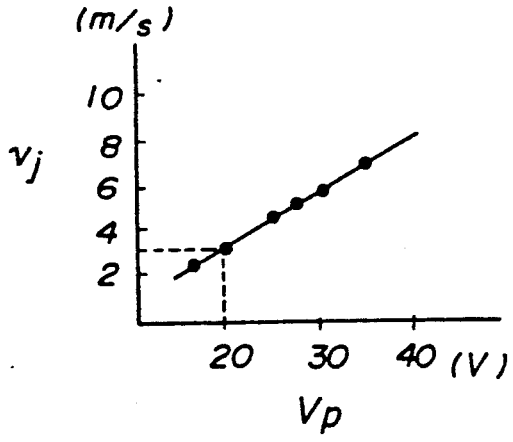
Figure 9A:
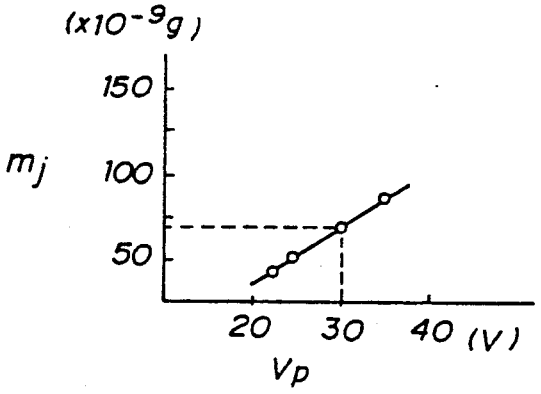
FIGS.9A and 9B show characteristic charts of the ink jet head of FIG.7 in the second operation mode when a drive voltage applied thereto is varied.
Figure 9B:
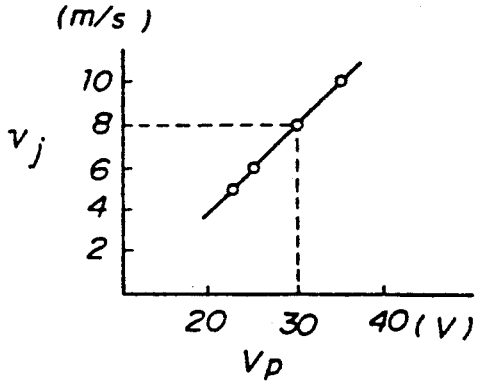

A description will now be given of the characteristics of the above described ink jet head when a drive voltage applied to the ink jet head is varied. FIGS.8A and 8B show experimental results when the ink jet head is operated in the first operation mode, that is, FIG.8A indicates how the ink drop weight mj changes when the drive voltage Vp (positive) is varied and FIG.8B indicates how the ink jet speed vj changes when the drive voltage Vp (positive) is varied. FIGS.9A and 9B show experimental results when the ink jet head is operated in the second operation mode, that is, FIG.9A indicates how the ink drop weight mj changes when the drive voltage Vp (negative) is varied and FIG.9B indicates how the ink jet speed vj changes when the drive voltage Vp (negative) is varied. Now, based on these experimental results, a comparison is made between the first and second operation modes when it is assumed that there is a relatively small ink drop weight, for example, approximately $70\times10^{-9}$ g, the ink jet speed vj of the first operation mode is about 3 m/s, as shown in FIG.8B, and the ink jet speed vj of the second operation mode is about 8 m/s, as shown in FIG.9B, which speed is greater than twice that of the first operation mode.

Figure 10A:
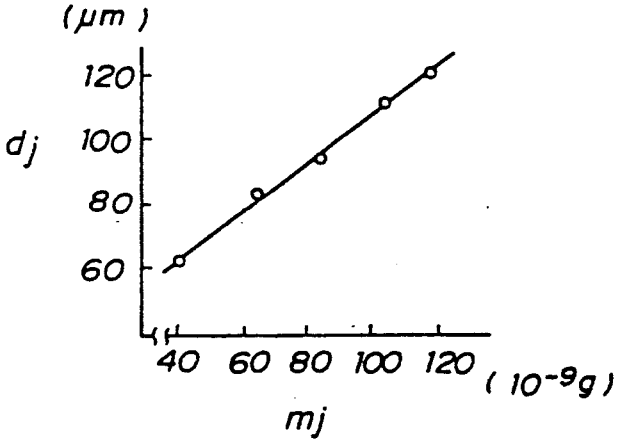
FIG.10 is a characteristic chart showing experimental result of the ink jet head of FIG.7.

Next, a description will be given of a method that enables the ink jet head shown in FIG.7 to perform both a 300 dpi printing and a 600 dpi printing. FIG. 10 shows experimental results which represent a relationship between the ink drop weight mj and the ink dot diameter dj for the above ink jet head, although this relationship may be slightly changed depending on the type of record paper being used. It is known from experience that an appropriate ink dot diameter corresponding to a given picture element density is an ink dot diameter 1/2 times as great as the dimension of a dot pitch which is determined by the given picture element density. Thus, the appropriate ink dot diameter for 300 dpi is about $120\times10^{-9}$ um, and the appropriate ink dot diameter for 600 dpi is about $60\times10^{-9}$ um. Based on these values of the ink dot diameters appropriate for given picture element densities, it is apparent from FIG.10 that the appropriate ink drop weight for 300 dpi is about $120\times10^{-9}$ g and the appropriate ink drop weight for 600 dpi is about $40\times10^{-9}$ g. One conceivable method for achieving both these ink drop weights with the ink jet head is to perform 300 dpi printing in the first operation mode and to perform 600 dpi printing in the second operation mode. According to FIGS 8A and 8B, the drive voltage in the first operation mode is about 27 V when the ink drop weight is about $120\times10^{-9}$ g, and the ink jet speed at that drive voltage is about 5 m/s, which corresponds to 300 dpi Similarly, according to FIGS. 9A and 9B, the drive voltage in the second operation mode is about 23 V when the ink drop weight is about $40\times10^{-9}$ and the ink jet speed at that ink drop weight is about 5 m/s, these data corresponding to 600 dpi printing. Thus, the same ink jet speed of about 5 m/s can be achieved for the above example of the ink jet head either when 300 dpi printing is performed in the first operation mode or when 600 dpi printing is performed in the second operation mode.

In the above case, it is difficult to achieve both 300 dpi printing and 600 dpi printing only in the first operation mode or in the second operation mode by means of the above ink jet head. When the ink jet head is operated only in the first operation mode, the ink jet speed must be lowered excessively to about 2 m/s to achieve an ink drop weight of about $40\times10^{-9}$ g appropriate for 600 dpi printing. Variations of ink jet speed due to image frequency changes or variations of ink jet speed among some ink jet heads within the same record apparatus lie within a very narrow range, and therefore it is difficult for the above ink jet head to produce stably an image with ink dots accurately positioned. On the other hand, when the ink jet head is operated only in the second operation mode, it is difficult to carry out printing with a relatively great ink drop weight. Based on the experimental results obtained when the above ink jet head was operated in the first operation mode, it has been concluded that it is impossible to achieve an ink drop weight of about $120\times10^{31\ 9}$ g appropriate for 300 dpi printing within a given range of the drive voltage described above. From the foregoing, it is understandable that the above method which makes the ink jet head perform 300 dpi printing in the first operation mode and perform 600 dpi printing in the second operation mode is effective for achieving both 300 dpi printing and 600 dpi printing with the same ink jet head.

Figure 7:
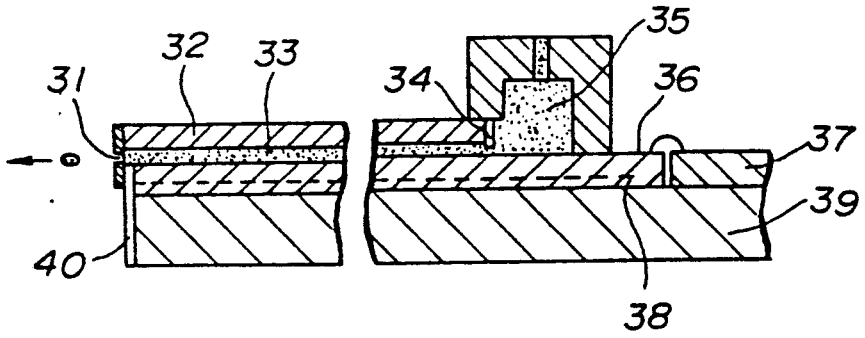
FIG.7 is a view showing an example of an ink jet head to which the present invention may be applied.
Figure 11A:
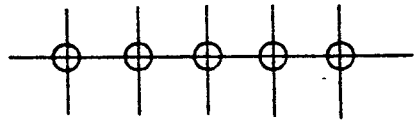
FIGS. 11A through 11C the diagrams showing a row of nozzles of the ink jet multiple nozzle head and a row of ink dots printed at 300, dpi and 600 dpi.
Figure 11B:
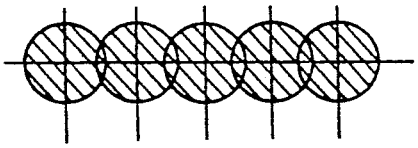
Figure 11C:
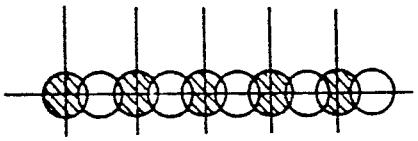

Next, a description will be given of a method for outputting an image at 300 dpi or 600 dpi on paper by means of a multiple-nozzle ink jet head, as shown in FIG. 7, in which a plurality of nozzles aligned in a sub scan direction. FIG. 11A shows a part of the arrangement of a plurality of nozzles which are provided in the ink jet heads, respectively. FIG.11B shows an example of ink dots which are aligned at 300 dpi in the sub scan direction of the printing apparatus, while FIG. 11C shows an example of ink dots which are arranged at 600 dpi in the sub scan direction thereof. The plurality of nozzles are arranged in the printing apparatus to cover one complete scan line of an image which is recorded at 300 dpi by one main scan. When a 600 dpi printing is performed, this main scan in the main scan direction is repeated twice on the same scan line. A first main scan is made to produce a first set of ink dots aligned at 300 dpi in the sub scan direction, which ink dots are indicated by hatching lines in FIG.11C. Then, a record paper is fed by a length equal to half a dot pitch corresponding to 300 dpi (=1/600 inch). And, a second main scan is made on the same scan line to produce a second set of ink dots aligned at 300 dpi in the sub scan direction, which ink dots are indicated with blank circles in FIG.11C, thus forming an image recorded at 600 dpi as shown in FIG.11C. By performing such a procedure, a 600 dpi printing for one page is completed.

The present invention has several advantageous features. For example, it is possible for the ink jet record apparatus to contain both a 300 dpi data and a 600 dpi data in the same page by the outputting method described above. For instance, after a 300 dpi data in printed on a record paper, the record paper is fed in the sub scan direction, reversely to a forward paper feed direction, to return the record paper back to a desired position of the record paper from which a 600 dpi printing is started. Then, a 600 dpi printing is carried out for a required region of that page by the outputting method described above. For example, when inserting a fine graphics image within a text data, it is possible to carry out a high-speed 300 dpi printing for a text data region first and a fine 600 dpi printing for a graphics image region. Another advantageous feature of the present invention is that the printer can employ a page memory for 300 dpi printing only. This memory is used as a full page memory when 300 dpi printing is performed, and when 600 dpi printing is performed the same memory can be used to deal with information corresponding to ¼ page size. In most cases, when inserting a graphics image in a character image on paper, the capacity of a memory provided in a printer which stores information equivalent to ¼ page size is adequate for carrying out a 600 dpi printing. Accordingly, it is possible to provide a printer applicable for practical use, because the printer can use a memory device with a low cost. This feature is advantageous, especially for color printers which require 4 times as much as monochrome printers.

Figure 12:
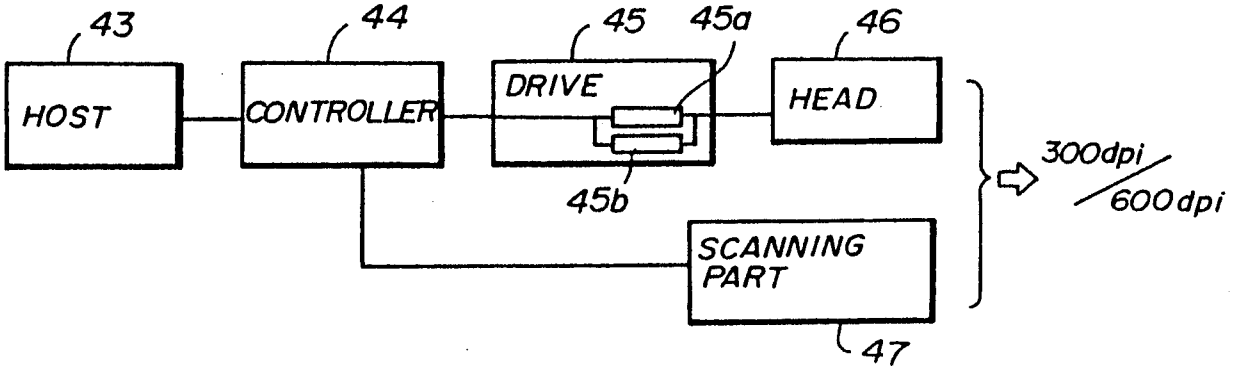
FIG.12 is a block diagram for explaining the construction of a circuit that constitutes the ink jet record apparatus according to the present invention.

FIG.12 shows the construction of a circuit system that constitutes the ink jet record apparatus according to the present invention. As shown in FIG.12, this circuit system generally has a host computer 43, a controller 44, a driver 45, an ink jet head 46 and a scanning part 47. This driver 45 comprises a first driver part 45*a* for carrying out a 300 dpi printing in the first operation mode (push-drive mode), and a second driver part 45*b* for carrying out a 600 dpi printing in the second operation mode (pull-drive mode). In accordance with input image information inputted to the host computer 43, the host computer 43 makes a determination on whether the ink jet head should be operated for a 300 dpi printing in the first operation mode or for a 600 dpi printing in the second operation mode. An instruction signal indicative of which operation mode is selected is supplied by the host computer to the controller 44; for driving and operating the driver 45. For example, when the input image information is a character data, the first driver part 45*a* for carrying out a 300 dpi printing in the first operation mode is selected from the driver 45, the ink jet head 46 is driven and operated for the 300 dpi printing in the first operation mode by the first driver part 45*a*, and the scanning part 47 is operated in accordance with the corresponding printing speed. Similarly, when the input image information is a graphics image data, the second driver part 45*b* is selected for the 600 dpi printing in the second operation mode and the ink jet head 46 is driven and operated. For instance, by controlling the scanning part 47 which moves the ink jet head 46 by one dot pitch in a sub scan direction, it is possible to carry out a printing which covers a range of one complete page with varying ink dot densities in accordance with the input image information.

Further, the present invention is not limited to the above embodiments, and variations and modifications may be made without departing from the scope of the present invention.

What is claimed is:

1. An ink jet recording apparatus for printing image data on record paper by using a drop-on-demand ink jet head, said ink jet recording apparatus comprising:

a multiple-nozzle ink jet head including a plurality of nozzles, a respective pressure chamber for each nozzle and a respective piezoelectric element provided adjacent to a surface of each pressure chamber, the plurality of nozzles being aligned on the multiple-nozzle ink jet head along a sub scan direction to cover a plurality of main scan lines of ink dots printed on the record paper extending in a main scan direction;

selection means for selecting an operation mode of said ink jet head from a first mode and a second mode in accordance with input image information;

control means for supplying a first drive signal to each of said piezoelectric elements of said ink jet head when the first mode is selected by said selection means and for supplying a second drive signal to each of said piezoelectric elements of said ink jet head when the second mode is selected by said selection means, the operation mode of said ink jet recording head being changeable from the first mode to the second mode or vice versa;

first drive means for driving and operating said ink jet head in the first mode so that rows of ink dots of relatively small dot density are printed along the main scan direction on the record paper; and second drive means for driving and operating said ink jet head in the second mode so that row of ink dots of relatively great dot density are printed along the main scan direction on the record paper.

said control means allowing ink dots at a first dot density P (dpi) to be printed in the main scan direction on the record paper by said ink jet head when the selection means selects the first mode, and allowing ink dots at a second dot density 2P (dpi) to be printed in the main scan direction on the record paper when the selection means selects the second mode, said first dot density being equal to half said second dot density, said ink jet recording apparatus further comprising paper feed means for feeding the record paper in the sub scanning direction by a length equal to a dot pitch 1(2P) when the selection means selects the second mode, said second drive means driving and operating the ink jet head in the second mode so that first rows of ink dots are printed on the record paper at the second dot density 2P (dpi) by a first scan in said main scan direction, then said paper feed means feeding the record paper by a length equal to 1/(2P), and said second drive means again driving and operating the ink jet head in the second mode so that second rows of ink dots are printed on the record paper at the second dot density 2P (dpi) by a second scan in said main scan direction.

2. The apparatus as claimed in claim 1, in which said paper feed means for feeding the record paper in the sub scan direction comprises means for feeding the paper in a reverse direction that is opposite to a forward sub scan direction, after a scan in the main scan direction when the selection means selects the second mode.

3. An ink jet recording apparatus for printing image data on record paper by using a drop-on-demand, multiple-nozzle ink jet head with dot density varying capability, said ink jet head including a plurality of nozzles, each of said nozzles communicating with a pressure chamber and including an oscillation plate having a piezoelectric element provided adjacent to the pressure chamber for each of the nozzles, said ink jet recording apparatus comprising:

selection means for selecting an operation mode of said ink jet head from among a first mode and a second mode in accordance with input image information, the image data being printed on the record paper at a relatively low dot density when said ink jet head is driven and operated in the first mode, but with the image data being printed on the record paper at a relatively high dot density when said ink jet head is driven and operate din the second mode;

control means for supplying a first drive signal to each of said piezoelectric elements of said ink jet head when the first mode of said ink jet head is selected by said selection means in accordance with the input image information and for supplying a second drive signal to each of said piezoelectric elements when the second mode of said ink jet head is selected by said selection means in accordance with the input image information;

first drive means for driving and operating said ink jet head in the first ode in response to the first drive signal supplied to each said piezoelectric element by said control means, to cause the ink jet head to print a column of ink dots of relatively large size which are aligned along a sub scan direction on the record paper, said column forming rows of ink dots extending in a main scan direction at a first dot density P (dpi) by one main scan in the main scan direction; and second drive means for driving and operating said ink jet head in the second mode in response to the second drive signal supplied to each said piezoelectric element by said control means, to cause said ink jet head to print a column of ink dots of relatively small size aligned along the sub scan direction on the record paper, said column of small size dots forming rows of ink dots in the main scan direction at a second dot density Q (dpi) by one main scan in the main scan direction.

4. The apparatus as claimed in claim 3, wherein each of said piezoelectric elements of said ink jet head is stressed such that: (i) a row of ink dots is printed on the record paper when the first drive signal supplied by said control means to the piezoelectric element rises from low level to high level and the piezoelectric element returns to a non-stressed condition when said first drive signal is gradually changed from high level to low level; and (ii) the piezoelectric element returns to a non-stressed condition from a stressed condition when the second drive signal supplied by said control means to the piezoelectric element is gradually changed from high level to low level and the piezoelectric element is placed again in a stressed condition so that a row of ink dots is printed on the record paper when said second drive signal rises from low level to high level.

5. The apparatus as claimed in claim 3, including a control apparatus causing the driving and operating of said ink jet head in the first mode by said first driving means to be carried out until all dots on one page included in the image data are printed on the record paper at the first dot density P (dpi), then causing the driving and operating of said ink jet head in the second mode by said second drive means to be carried out until all dots of the page included in the image data are printed on the same record paper at the second dot density Q (dpi).

6. The apparatus as claimed in claim 3, wherein said control means allows ink dots at a first dot density P (dpi) to be printed in the main scan direction on the record paper by said first drive means when the selection means selects the first operative mode, and allows ink dots at a second dot density 2P (dpi) to be printed in the main scan direction on the record paper by said second drive means when the section means selects the second operation mode, said first dot density being equal to half said second dot density.

7. A method for recording image data on record paper by using a drop-on-demand ink jet head with dot density varying capability, said ink jet head including a nozzle, a pressure chamber containing ink and communicating with the nozzle, and an oscillation plate having a piezoelectric element provided adjacent to the pressure chamber, said method comprising steps of:

selecting an operation mode of said ink jet head from among a first mode and a second mode in accordance with input image information, the image data being printed on the record paper at a relatively low dot density when said ink jet head is driven and operated in the first mode but the image data being printed on the record paper at a relatively high dot density when said ink jet head is driven and operated in the second mode;

supplying a first drive signal to said piezoelectric element of said ink jet head when the first mode of said ink jet head is selected in accordance with the input image information but supplying a second drive signal to said piezoelectric element when the second mode of said ink jet head is selected in accordance with the input image information;

driving and operating said ink jet head in the first mode in response to the first drive signal supplied to said piezoelectric element such that an ink drop of relatively large size is ejected from the nozzle of said ink jet head to print a dot included in he image data on the record paper when said piezoelectric element is stressed, when the pressure chamber is refilled with ink when said piezoelectric element returns back to a non-stressed condition;

driving and operating said ink jet head in the second mode in response to the second drive signal supplied to said piezoelectric element such that said pressure chamber is refilled with ink when said piezoelectric element is changed from a stressed condition to a non-stressed condition and than an ink drop of relatively small size is ejected from the nozzle of said ink jet head to print a dot included in the image data on the record paper when said piezoelectric element is again stressed; and repeating the aforementioned steps until all the dots of one complete page included in the image data are printed on the record paper.

8. A method for recording image data on record paper by using a drop-on-demand, multiple-nozzle ink jet head with dot density varying capability, said ink jet head including a plurality of nozzles, each of said nozzles communicating with a pressure chamber and including an oscillation plate having a piezoelectric element provided adjacent to the pressure chamber for each of the nozzles, said method comprising steps of:

selecting an operation mode of said ink jet head from among a first mode and a second mode in accordance with input image information, the image data being printed on the record paper at a relatively low dot density P (dpi) when said ink jet head is driven and operated in the first mode but the image data being printed on the record paper data relatively high dot density P (dpi) when said ink jet head is driven and operated in the second mode;

supplying a first drive signal to each of said piezoelectric elements of aid ink jet head when the first mode of said ink jet head is selected in accordance with the input image information and supplying a second drive signal to each of said piezoelectric elements when the second mode of said ink jet head is selected in accordance with the input image information;

driving and operating said ink jet head in the first mode in response to the first drive signal supplied to said piezoelectric elements such that a row of ink drops of relatively large size aligned along a sub scan line is printed on the record paper in a main scan direction at a first dot density P (dpi) in one main scan;

driving and operating said ink jet head in the second mode in response to the second drive signal supplied to each said piezoelectric element such that a first row of ink drops of relatively small size aligned along a sub scan line is printed on the record paper in the main scan direction at a second dot density Q (dpi) in a first main scan, then feeding the record paper in sub scan direction by a length equal to a dot pitch 1/Q corresponding to the second dot density Q, and again driving and operating said ink jet head in the second mode so that a second row of ink drops of the relatively small size along a sub scan line is printed on the record paper in the main scan direction at the second dot density Q (dpi) by a second main scan; and repeating the aformentioned steps until all the dots of one complete page included in the image data are printed on the record paper.

9. The method as claimed in claim 8, wherein said second dot density Q (dpi) is equal to twice said first dot density P (dpi).

10. The method as claimed in claim 9, wherein said first dot density P is equal to 300 dpi and said second dot density Q is equal to 600 dpi.

11. The method as claimed in claim 8, wherein aid driving and operating of said ink jet head in the first mode are repeated until all dots of one page included in the image data are printed on the record paper at the first dot density P (dpi), then said driving and operating of said ink jet head in the second mode are repeated until all dots of one page included in the image data are printed on the same record paper at the second dot density Q (dpi).

* * * * *